US005282279A

United States Patent [19]

Hinton et al.

[11] Patent Number: 5,282,279

[45] Date of Patent: Feb. 1, 1994

[54] CHAIR ACCESSIBLE TOILET FACILITY

[75] Inventors: Anthony Hinton, Chicago; Norman Singer, Riverwoods, both of Ill.

[73] Assignee: Hinton/Singer Limited Partnership

[21] Appl. No.: 977,528

[22] Filed: Nov. 17, 1992

[51] Int. Cl.[5] ..... A47K 11/12; E03D 11/00

[52] U.S. Cl. ..... 4/144.1; 4/254; 4/480; 297/423.14; 604/331; 604/353

[58] Field of Search ..... 4/254, 574.1, 480, 144.1, 4/144.2, 144.3, 144.4; 297/424, 425, 438, 439; 128/760; 604/331, 351, 353

[56] References Cited

U.S. PATENT DOCUMENTS

| | | | |
|---|---|---|---|
| 269,780 | 12/1882 | Fenny | 297/439 |
| 1,038,388 | 9/1912 | Kiessig | 4/254 |
| 1,155,885 | 10/1915 | Catchings | 4/254 X |
| 1,243,148 | 10/1917 | Erwin | 4/254 X |
| 1,668,242 | 5/1928 | Griffith | 4/254 |
| 1,798,632 | 3/1931 | Romer | 4/254 |
| 1,972,233 | 9/1934 | Moulder | 4/235 |
| 2,182,979 | 12/1939 | Bruzenak | 4/300 |
| 2,250,060 | 7/1941 | Finlay | 4/254 |
| 4,012,797 | 3/1977 | Kristoffersen | 4/254 X |
| 4,713,846 | 12/1987 | Hodroski, Jr. | 4/254 |
| 4,955,922 | 9/1990 | Terauchi | 4/480 |

OTHER PUBLICATIONS

Medical Services International, "Urological Products" Brochure, 4 pages.

*Primary Examiner*—Robert M. Fetsuga

*Attorney, Agent, or Firm*—Marshall, O'Toole, Gerstein, Murray & Borun

[57] ABSTRACT

A footrest for use by a person seated in a wheel-chair facing a toilet facility includes an upper surface capable of accepting a foot thereon and slanting downwardly generally towards the front of the toilet facility. The footrest also includes a lip attached to the upper surface for retaining the foot on the upper surface at a fixed location.

17 Claims, 4 Drawing Sheets

FIGURE 1
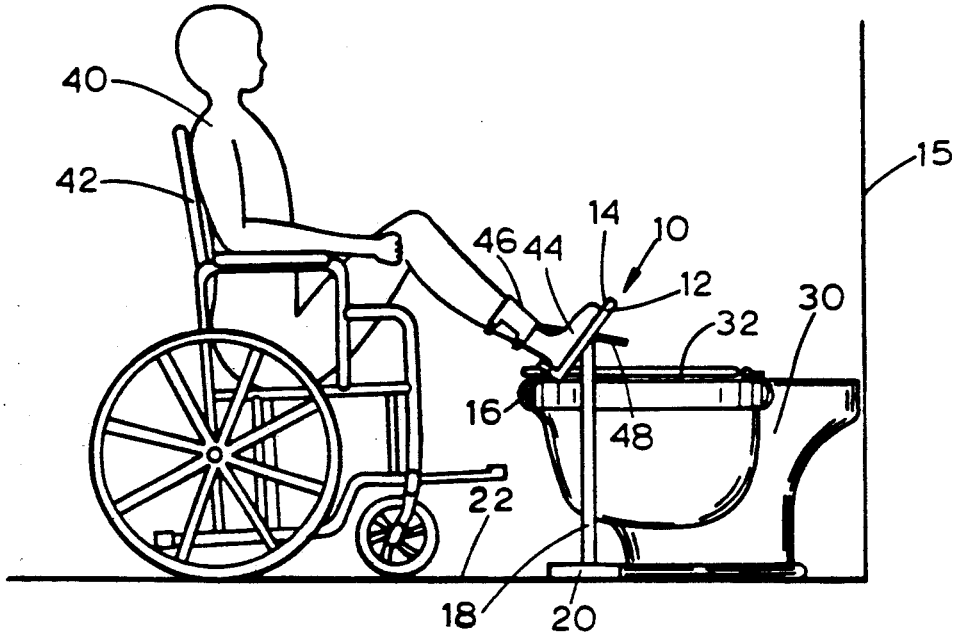
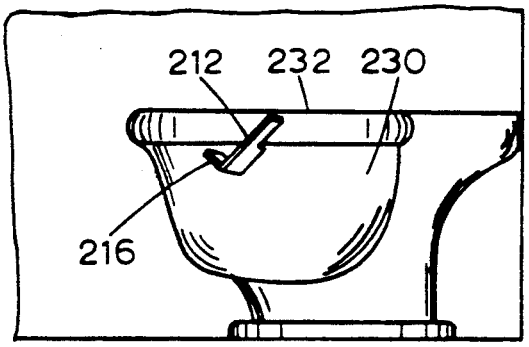
FIGURE 2
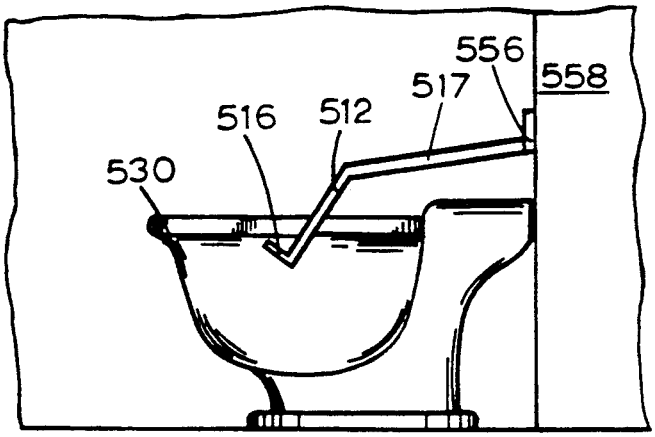
FIGURE 5

CHAIR ACCESSIBLE TOILET FACILITY

TECHNICAL FIELD

The present invention relates generally to toilet facilities, and more particularly to footrests for use in conjunction with a toilet.

BACKGROUND ART

Although restroom facilities have been modified for use by physically disabled persons with, for example, the addition of bars, rails and wider stalls, there is still a certain group of persons, namely, persons confined to wheelchairs, for whom restrooms remain difficult if not impossible to use. These persons usually wear leg bags into which they discharge their urine. A leg bag is normally attached to a shin or calf area of the user's legs and must be periodically emptied into a toilet facility which is typically done while the user is seated in the wheelchair facing the toilet facility. It is difficult, however, for persons confined to wheelchairs to empty their leg bags in present toilet facilities because the leg bag must be placed in close proximity to a rim of the toilet in order to be emptied. At the present time, persons confined to wheelchairs who use leg bags accomplish this act by lifting their legs and resting them on a rim of the toilet facility. However, because toilets are usually made of porcelain or other slick materials and because these persons do not have muscle control in their legs, the leg frequently slips off the toilet rim thereby causing an unsanitary condition. Thus, there is an urgent need for a foot and heel support system which will allow a person seated facing a toilet facility to place his or her foot on a footrest adjacent to the toilet facility and to eliminate the contents of a leg bag while the foot is supported in a stable and comfortable position.

Toilet facilities having footrests are known in the prior art. For example, Romer, U.S. Pat. No. 1,798,632 discloses a toilet facility having a U-shaped footrest resting on a floor and slanting downward towards the rear of a toilet to enable a person to assume the squatting position while using the toilet facility. Likewise, Catchings, U.S. Pat. No. 1,155,885; Finlay, U.S. Pat. No. 2,250,060 and Kristoffersen, U.S. Pat. No. 4,012,797 discloses toilet facilities having substantially flat footrests positioned on either side of a toilet to enable a person to assume the squatting position while using the toilet. Moulder, U.S. Pat. No. 1,972,233 discloses a toilet facility having multiple seats and a flat footrest to enable use of the facility by smaller children. Griffith, U.S. Pat. No. 1,668,242 discloses a toilet device having a footrest which moves a person seated in a wheelchair on to a toilet facility to enable use of that facility. Bruzenak, U.S. Pat. No. 2,182,979 discloses a toilet facility including handrails which facilitates use of the facility in the squatting position. None of these prior art references, however, discloses a footrest adapted to be used by a person while seated in a chair facing the toilet facility or a footrest that allows a person to empty a leg bag from a seated position in front of the toilet facility with a foot located in a stable and comfortable position.

SUMMARY OF THE INVENTION

These disadvantages are substantially overcome by the present invention. Thus, in accordance with one aspect of the present invention, an apparatus for supporting a foot in relation to a toilet facility including a toilet having a front and located above a floor comprises a supporting means for supporting a foot above the floor in proximity to the toilet. The supporting means includes an upper surface capable of accepting a foot thereon and slanting downwardly generally towards the front of the toilet facility. The apparatus further includes retaining means for retaining the foot on the supporting means at a fixed location.

Preferably, the retaining means includes a lip connected to, and extending above, at least a portion of the upper surface for holding the foot securely on the upper surface at a fixed height. The retaining means may also include a high friction coefficient material attached to the upper surface for holding the foot on the upper surface. Preferably, the supporting means includes a support member connecting the upper surface to the floor thereby transferring the weight of a foot from the upper surface to the floor. The supporting means may support a foot at a height above the floor approximately equal to the height of a rim of the toilet or, in the alternative, at a height greater than or less than the height of the rim of the toilet. Alternatively, the supporting means and the retaining means may be integrally formed with the toilet.

In an alternative embodiment, the supporting means includes first and second supporting means located adjacent to but on opposite sides of the toilet for supporting a foot above the floor in proximity to the toilet. In this embodiment, first and second retaining means retain the foot on the first and second supporting means, respectively, at fixed locations. Preferably, the first and second supporting means include first and second upper surfaces, respectively, slanting downwardly generally toward the front of the toilet facility.

In still a further alternative embodiment, the supporting means includes connecting means for connecting the upper surface to a wall adjacent the toilet facility and may include a support member connected to the upper surface having a fastener extending therethrough for connection into the wall. In this embodiment, the upper surface may extend into a hole in the wall when the support member is connected to the wall.

In a further aspect of the present invention, an improvement in a toilet facility having a toilet located above a floor comprises a supporting means for supporting a foot of a person seated in a chair facing the toilet, the supporting means supporting the foot at a height above the floor so as to enable the person to empty the contents of a waste collection bag attached to a leg of the person. The improvement also includes retaining means attached to the supporting means for retaining the foot on the supporting means.

Preferably, the supporting means includes an upper surface slanting downwardly generally towards the front of the toilet facility and the retaining means includes a lip attached to the upper surface for holding the foot on the upper surface at a predetermined height.

In alternative embodiments, the retaining means may include an upper surface slanting downwardly generally towards the toilet or may include a ledge attached to the toilet having an indentation formed therein for holding a foot on the ledge.

In still another aspect of this invention, a toilet facility comprises a toilet and a footrest. Preferably the footrest includes an upper surface slanting downwardly generally towards the front of the toilet for accepting a foot such that a toe of the foot is positioned above a heel of the foot, and a retainer extends above at least a portion of the upper surface for holding a foot at a fixed location with respect to the upper surface.

Also preferably, the footrest is connected to the toilet or, in an alternative embodiment, the footrest is integrally formed with the toilet or, in still another alternative embodiment, the toilet facility includes a supporting means for supporting the toilet and the footrest.

BRIEF DESCRIPTION OF THE DRAWING

These and other features and advantages will become more apparent from a detailed consideration of the invention when taken in conjunction with the drawing, in which:

FIG. 1 is a side view of the toilet facility footrest of the present invention;

FIG. 2 is a side view of a second embodiment of the footrest of the present invention;

FIG. 5 is a side view of a second wall-mounted embodiment of the footrest of the present invention;

DESCRIPTION OF THE PREFERRED EMBODIMENTS

Figure 3:
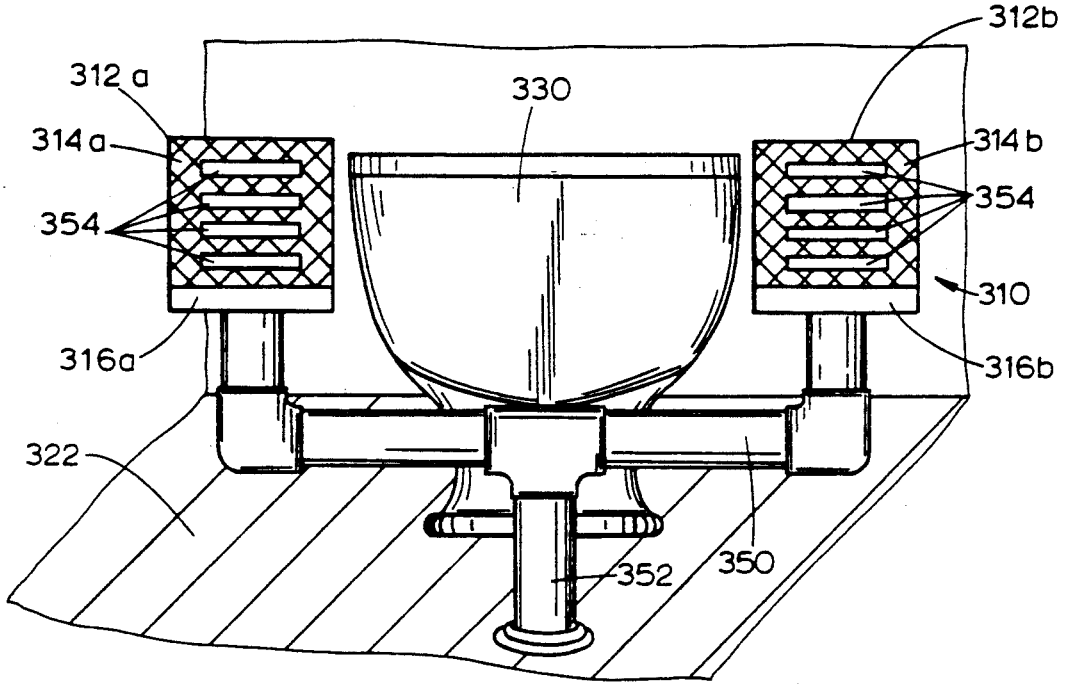
FIG. 3 is a front view of a double footrest embodiment of the present invention.

FIG. 1 shows a side view of a footrest 10 according to the present invention including a plate 12 having an upper surface 14. Typically the upper surface 14 is flat and slants downwardly generally towards the front of the footrest 10 and away from a wall 15 as shown in FIG. 1. The footrest 10 also includes a lip 16 which connects to a lower portion of the plate 12 and preferably extends substantially perpendicular to, and above at least a portion of the upper surface 14. The lip 16 may, however, extend above a portion of the upper surface 14 in a substantially perpendicular to, and above at least manner other than perpendicularly. A bar 18 supports the plate 12 and the lip 16 and connects through a fixture 20 to a floor 22. The bar 18 in conjunction with the fixture 20 transfers the weight of objects placed on the plate 12 to the floor 22. Fixture 20 is fastened to the floor in a suitable manner, for example, with bolts or glue.

The footrest 10 is located adjacent a toilet 30 such that the plate 12 is located at a height approximately equal to the height of a rim 32 of the toilet 30. However, the plate 12 can be located at a height either greater than or less than the height of the rim 32, wherein this position is determined primarily by user comfort considerations.

In use, a person 40 seated in, for example, a wheelchair 42, places a foot 44 on the footrest 10 such that a sole of the foot 44 rests on the upper surface 14 of the plate 12 and a heel of the foot presses against the lip 16. In this manner, the foot 44 is supported at a predetermined height on the footrest 10 with the heel of the foot 44 resting at a location below a toe of the foot. With the foot 44 placed on the footrest 10, as shown in FIG. 1, the person 40 can utilize gravity to empty the contents of a leg bag 46 from, for example, an outlet 48 existing therein, into the toilet 30 while the foot 44 remains in a fixed and comfortable position at a location adjacent the toilet 30. In this manner, the footrest 10 reduces the risk of spillage of the contents of the leg bag 46 during emptying thereof.

An alternative embodiment of the present invention is shown in FIG. 2. In this embodiment, a plate 212 and a lip 216 are connected to a toilet 230 at a predetermined vertical height which is below a rim 232 of the toilet 230. Preferably, the plate 212 and the lip 216 are integrally formed with the toilet 230 and, as such, are made of the same material, for example, porcelain, as the toilet 230. In this embodiment, the toilet 230 in conjunction with the plate 212 act as a supporting means for the footrest which is used in the same manner as described in conjunction with the embodiment of FIG. 1.

A front view of an alternative embodiment of the invention is shown in FIG. 3 which includes a footrest 310 having plates and **312*b* and lips 316*a* and 316*b* on opposite sides of a toilet 330. The plates 312*a* and 312*b* and the lips 316*a* and 316*b* are supported by a U-shaped support bar 350 connected to a floor 322 through a second support bar 352. The support bars 350 and 352** are preferably made of metal; however, they can be made of any other suitable material.

Strips of high friction coefficient material 354 are located on the surfaces **314*a* and 314*b* of the plates 312*a* and 312*b*, respectively, and further serve to retain a foot on the plates 312*a* and 312*b* when the sole of the foot comes into contact with the high friction coefficient material 354. It should be noted that the high friction coefficient material 354 can be placed in any suitable pattern or design on the upper surfaces 314*a* and 314*b* of the plates 312*a* and 312*b*. The high friction coefficient material 354 can also be used in conjunction with all the embodiments of the invention disclosed herein, and are only mentioned with reference to FIG. 3 for the sake of simplicity. With this embodiment, a person seated in a chair facing the toilet 330 can place either or both feet on the plates 312*a* and 312*b* of the footrest 310**.

Figure 4:
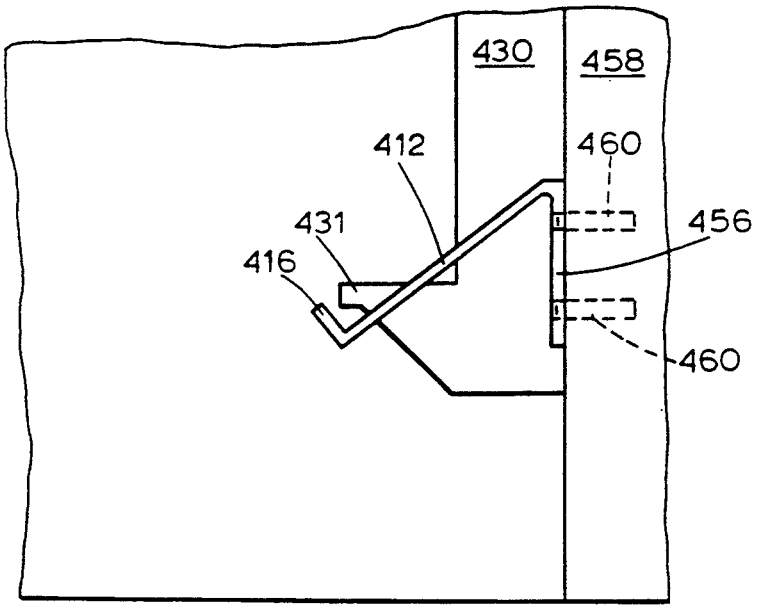
FIG. 4 is a side view of a wall-mounted embodiment of the footrest of the present invention.

FIG. 4 shows a side view of a wall-mounted embodiment of the footrest used in conjunction with a urinal 430 having a rim 431. In this embodiment, a support plate 456 lies adjacent a wall 458 and connects to an upper end of a plate 412 having a lip 416 attached thereto such that the support plate 456 extends below a portion of the plate 412. Fasteners 460 extend through the support plate 456 and into the wall 458 for holding the support plate 456 in a rigid position. In this manner, the plate 412 and the lip 416 are supported by the wall 458 at a predetermined height and location with respect to the urinal 430. Preferably, the plate 412 and lip 416 are located at a height substantially equal to the rim 431 of the urinal 430.

FIG. 5 shows a side view of a wall-mounted embodiment of the present invention wherein a support plate 556 connects to a wall 558 and supports a plate 512 and a lip 516 adjacent a toilet 530 in a manner similar to that described in conjunction with FIG. 4. In this embodiment, however, the support plate 556 connects to the plate 512 through a support member 517 and extends vertically above the plate 512.

Figure 6:
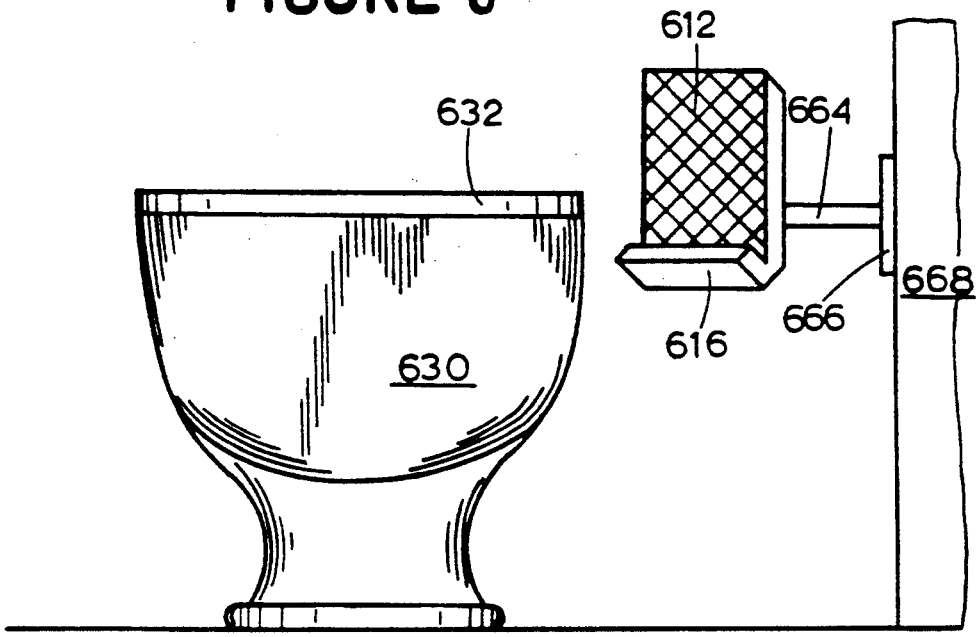
FIG. 6 is a front view of a third wall-mounted embodiment of the footrest of the present invention.

FIG. 6 shows an alternate embodiment of a wall-mounted footrest of the present invention wherein a support bar 664 and a support plate 666 are attached to a side wall 668 in any conventional manner and laterally support a plate 612 and a lip 616 adjacent a toilet 630. Preferably, the plate 612 is located at a height approximately equal to a rim 632 of the toilet 630; however, as with all the embodiments of this invention, the plate 612 and the lip 616 can be supported at any vertical height.

Figure 7:
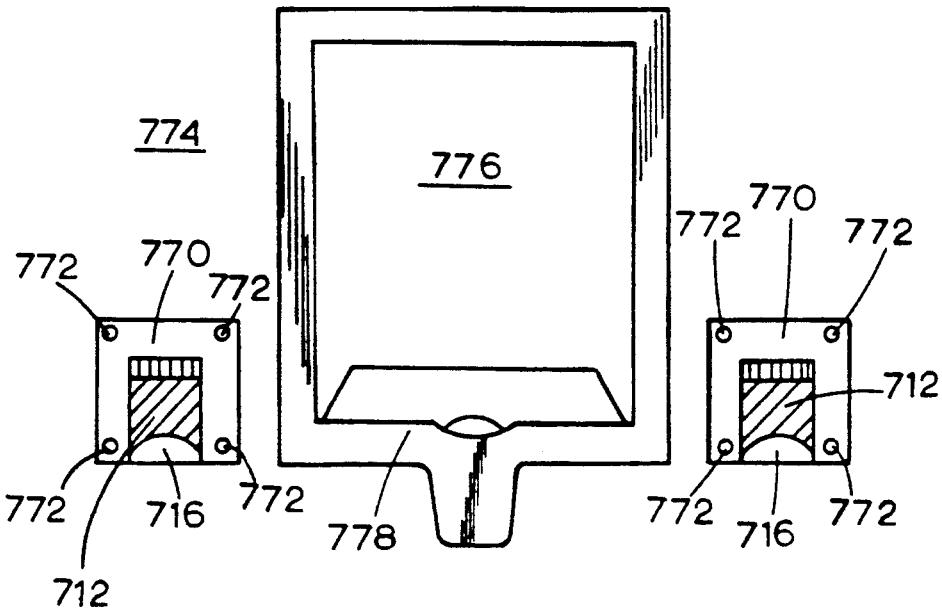
FIG. 7 is a front view of a fourth wall-mounted embodiment of the footrest of the present invention.

FIG. 7 shows a front view of an embodiment of the invention used in conjunction with a urinal. In this embodiment, U-shaped fastening plates 770, having fasteners 772 extending therethrough into a wall 774, support plates 712 and lips 716 adjacent a urinal 776 such that the plates 712 are supported at a vertical height approximately equal to the height of a rim 778 of the urinal 776. In this embodiment, the plates 712 may extend into recesses of the wall 774 such that the lips 716 are located approximately even with the wall 774.

Figure 8:
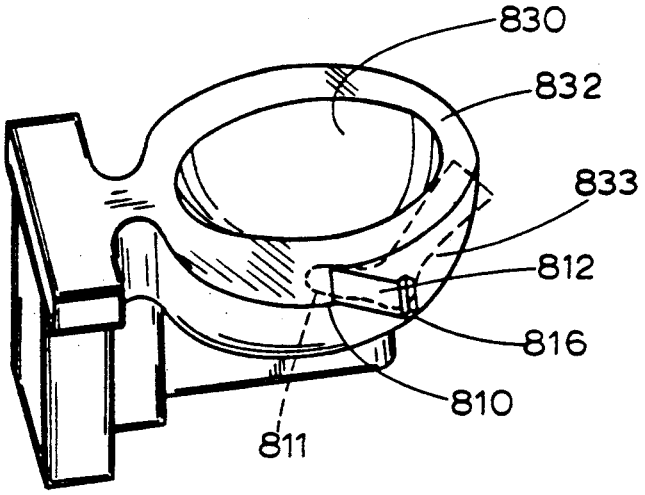
FIG. 8 is a perspective view of an embodiment of the footrest wherein the footrest is integrally formed with a toilet.

FIG. 8 shows a perspective view of a toilet facility having a footrest 810 integrally formed with a toilet 830. As such, the footrest 810 is made of the same material as the toilet 830 and may, therefore, be formed in the same molding process as the toilet 830. A foot 811, shown in phantom line, rests on the foot rest 810 as indicated in FIG. 8. The footrest 810 includes an upper surface 812 slanting downwardly generally towards the front of a toilet facility. A retainer 816, for example, a lip, is attached to the plate 812 and preferably is attached to a side 833 of the toilet 830. For ease in normal use of the toilet 830, the upper surface 812 extends to the same height as a rim 832 of the toilet 830. The lip 816 may be positioned at any height below the rim 832 with the exact position being determined by ease of use of the footrest in emptying a leg bag. In this embodiment, the surface 812 and the retainer 816 act as retaining means while the toilet 830 acts as a supporting means.

Figure 9:
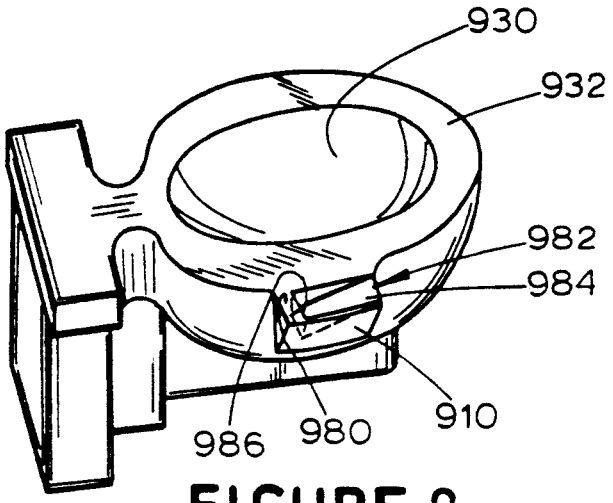
FIG. 9 is a perspective view of a further embodiment of the footrest wherein the footrest is integrally formed with the toilet.

FIG. 9 shows a perspective view of a toilet facility having a footrest 910 integrally formed with a toilet 930. A ledge 980 extends out from a rim 932 of the toilet 930. An indentation 982 is formed within the ledge 980 such that an upper surface 984 slants generally downward toward the rear of the toilet facility. A wall 986 extends downward from the ledge 980 to a lower portion of the upper surface 984. In use, a person places a foot on the footrest 910 so that a heel on the foot rests on the upper surface 984 and a bottom of the foot comes into contact with the wall 986. In such a manner, the foot will be supported by the footrest 910 at a fixed location with respect to the rim 932 of the toilet 930.

Figure 10:
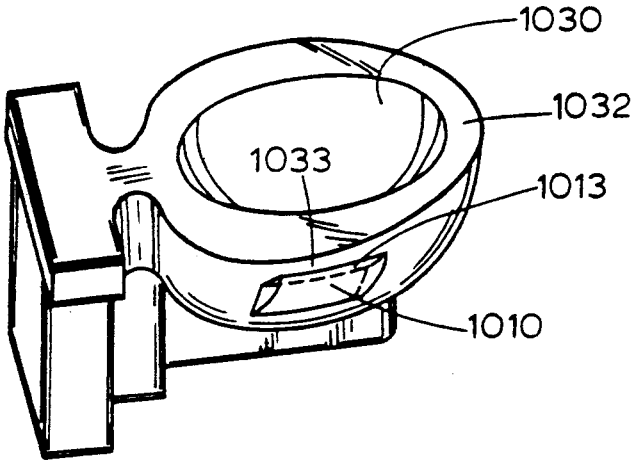
FIG. 10 is a perspective view of a still further embodiment of the footrest wherein the footrest is integrally formed with the toilet.

FIG. 10 shows a perspective view of an alternative embodiment of the invention having a footrest 1010 integrally formed with the toilet 1030 at a location below a rim 1032 of the toilet 1030. In this embodiment, the footrest 1010 has an upper surface 1013 slanting downwardly generally towards the toilet 1030 thereby defining a space directly between the upper surface 1013 and a side 1033 of the toilet 1030. In use, a person places a foot in the space between the side 1033 of the toilet 1030 and the upper surface 1013, such that the heal of the foot comes into contact with both the upper surface 1013 and the side 1033 of the toilet 1030. In this manner, the foot will be supported at a predetermined height with respect to the toilet 1030.

It should be noted that the footrest of the present invention may include Only the plate 12 having an upper surface 14 and the high friction coefficient material 354 attached thereto. It should also be noted that either a single or double footrest version of the invention can be used in any of the embodiments of the footrest disclosed herein and that any of the embodiments of the footrest 10 disclosed herein can be used in conjunction with any toilet facility, including a toilet, a urinal and any other defecation or urination apparatus. The term "toilet," as used herein, includes what is commonly referred to as a urinal.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A toilet facility comprising:

a toilet adapted to be located above a floor and having a front portion and a back portion;

supporting means for supporting a foot of a person above the floor in proximity to the toilet, the supporting means, being positioned laterally of the toilet and including an upper surface capable of accepting the foot thereon and slanting downwardly generally towards the front portion and away from the back portion of the toilet, to support the toes of the foot above the heel of the foot; and retaining means for retaining the foot on the supporting means at a fixed location, the retaining means including a lip structure connected to and extending above at least a portion of the upper surface for engaging the back of the heel of the foot when the foot is supported on the upper surface.

2. The toilet facility as recited in claim 1 wherein said retaining means retains the foot on the supporting means at a fixed location with the heel of the foot being retained closer to the front of the toilet than the toes of the foot.

3. The toilet facility of claim 2 wherein the supporting means and the retaining means are integrally formed with the toilet.

4. The toilet facility of claim 2 wherein the supporting means includes a support member adapted to connect the upper surface to the floor for transferring the weight of a foot from the upper surface to the floor.

5. The toilet facility of claim 4 wherein the retaining means includes a non-slip material attached to the upper surface.

6. The toilet facility of claim 4 wherein the supporting means supports the foot at a height above the floor approximately equal to the height of a rim of the toilet.

7. The toilet facility of claim 4 wherein the supporting means supports the foot at a height above the floor greater than the height of a rim of the toilet.

8. The toilet facility of claim 2 wherein the supporting means includes second supporting means located on the opposite side of the toilet for supporting a foot above the floor in proximity to the toilet and second retaining means for retaining the foot on the second supporting means, wherein the second supporting means includes second upper surface slanting downwardly gene ally towards the front portion of the toilet facility.

9. The toilet facility of claim 2 wherein the supporting means includes connecting means for connecting the upper surface to a wall adjacent the toilet.

10. The toilet facility of claim 9 wherein the connecting means includes a support member, connected to the upper surface, having a fastener extending therethrough for connection into the wall.

11. The toilet facility of claim 10 wherein the upper surface is adapted to extend into a hole in the wall when the support member is connected to the wall.

12. The toilet facility of claim 1 wherein the retaining means includes a non-slip material attached to the upper surface.

13. A toilet facility comprising:

a toilet adapted to be located above a floor and having a front portion and a back portion;

supporting means for supporting a foot of a person seated in a chair facing the front portion of the toilet, said supporting means being positioned laterally of the toilet and including support surface means disposed near a rim of said toilet and slanting downwardly generally towards the front portion and away from the back portion of the toilet for physically supporting the foot of the person seated in the chair facing said toilet at a height above the floor so as to enable the person to empty the contents of a waste collection bag attached to a leg of the person under the force of gravity into said toilet; and retaining means attached to the supporting means for retaining the foot on the supporting means, the retaining means including foot supporting means for engaging the back of the heel of the foot when the foot is supported on the support surface means.

14. The toilet facility of claim 13 wherein the foot supporting means is located at a height approximately equal to the height of the rim of the toilet.

15. The toilet facility of claim 13 wherein the foot supporting means includes a lip attached to the support surface means for holding the foot on the supporting means.

16. The toilet facility of claim 15 wherein the supporting means includes a support member adapted to connect the support surface means to the floor for transferring the weight of the foot from the support surface means to the floor.

17. A method of facilitating the emptying into a toilet of the contents of a urine bag secured below the knee to a disabled leg of a person in a wheelchair comprising the steps of:

positioning the foot of the disabled leg on a footrest disposed near the rim of the toilet such that at least a portion of the foot and the urine bag secured to the disabled leg is disposed above the rim of the toilet, said positioning step including the step of maintaining a heel of the foot securely engaged with said footrest with said heel being disposed on said footrest below any toe of the foot, said positioning step further including said footrest having a slanting upper surface providing for the step of maintaining said foot angularly disposed with respect to said rim of said toilet with the heel of said foot being disposed closer to the front of the toilet when the disposition of any toe of said foot; and utilizing gravity, emptying the contents of the urine bag into the toilet.

* * * * *

UNITED STATES PATENT AND TRADEMARK OFFICE

CERTIFICATE OF CORRECTION

PATENT NO. : 5,282,279

DATED : February 1, 1994

INVENTOR(S) : Hinton, et al.

It is certified that error appears in the above-identified patent and that said Letters Patent is hereby corrected as shown below:

On the title page, under OTHER PUBLICATIONS, delete "Services" and substitute therefor --Devices--.

At column 3, line 50, delete "substantially perpendicular to, and above at least".

At column 4, line 25, after "plates" insert --312a--.

At column 5, line 66, delete "Only" and substitute therefor --only--.

At column 8, line 32, delete "when" and substitute therefor --than--.

Signed and Sealed this

Sixth Day of September, 1994

Bruce Lehman

*Attest:*

BRUCE LEHMAN

*Attesting Officer*

*Commissioner of Patents and Trademarks*